US005713820A

United States Patent [19]

Carbone

[11] Patent Number: 5,713,820

[45] Date of Patent: Feb. 3, 1998

[54] EQUIPMENT FOR CARRYING OUT ANTERIOR AND POSTERIOR FOOT AND LOWER LIMBS FLEXION EXERCISES

[76] Inventor: Giuseppe Carbone, 16, Via Lambertesca, 50122 Firenze, Italy

[21] Appl. No.: 728,390

[22] Filed: Oct. 9, 1996

[30] Foreign Application Priority Data

Oct. 11, 1995 [IT] Italy ..... FI95A0208

[51] Int. Cl.[6] ..... A63B 23/10

[52] U.S. Cl. ..... 482/79; 482/907

[58] Field of Search ..... 482/79, 80, 105, 482/146, 74, 907, 132

[56] References Cited

U.S. PATENT DOCUMENTS 2,214,052 9/1940 Good ..... 482/79

3,472,508 10/1969 Baker et al. ..... 482/79

4,605,225 8/1986 Torii ..... 482/146

4,848,742 7/1989 Lindley et al. ..... 482/146

5,135,450 8/1992 Smith, IV ..... 482/80

*Primary Examiner*—Lynne A. Reichard

*Attorney, Agent, or Firm*—Browdy and Neimark

[57] ABSTRACT

Equipment for carrying out anterior and posterior flexion exercises of the foot and lower limbs for athletic training and rehabilitation comprising a surface (2) for the foot to rest on connected to a curved surface (3) suited to roll on the plane of execution of the exercise and able to provoke, following a corresponding movement of the body, the forward and backward inclination of the footrest surface. Means for the adjustment of the footrest (7) as well as means for fastening the foot to said rest are provided. The curved surface is formed by two portions of different extent and radii of curvature.

14 Claims, 2 Drawing Sheets

EQUIPMENT FOR CARRYING OUT ANTERIOR AND POSTERIOR FOOT AND LOWER LIMBS FLEXION EXERCISES

FIELD OF THE INVENTION

The present invention relates to equipment for carrying out anterior and posterior foot and lower limbs flexion exercises, particularly for athletic training and rehabilitation.

BACKGROUND OF THE INVENTION

It is well known that the development of many traumatic pathologies of the foot and lower limbs is furthered by conditions of either laxity or rigidity of muscles and ligaments as well as by cases of muscular contraction. Currently, to prevent the development of such complications following traumas, but also, more generally, for rehabilitative purposes and athletic training to maintain the correct elasticity of the articulatio pedis, the only practical therapy in use is passive manipulation by means of massage.

Therefore, for reasons of both convenience and cost, there is a great demand for a way to avoid, or at least limit, the need to resort to massage in the abovementioned cases by substituting or integrating the massaqe with anterior and posterior foot flexion exercises that can be carried out directly by the patient at the times and places of his or her choice.

The object of the present invention is, therefore, to provide a piece of equipment for carrying out anterior and posterior foot and lower limb flexion exercises which fulfills the above-mentioned demands and which is easy to use and transport as well as inexpensive. A further object of the present invention is to provide a piece of equipment of the type described above which is suited to be used for training in many sports or, in activities in which a high degree of elasticity of the articulatio pedis is required.

Another object of the present invention is to provide a piece of equipment of the above-mentioned type whose use helps in the improvement of posture, as well as in the acquisition of a greater sense of equilibrium and improvement of gait.

SUMMARY OF THE INVENTION

These objects are accomplished by the equipment for carrying out anterior and posterior foot and lower limb flexion exercises according to the present invention which comprises a footresting surface member which is connected to a curved surface member suited to roll on the plane of execution of the exercise and is able to provoke, following a corresponding movement of the body, the forward or backward inclination of the footresting surface member. For correct positioning of the foot on the footrest, the latter is provided with means for adjusting it to the size of the foot as well as means, in particular of a strap type, for fastening the footresting surface member.

In a particularly preferred embodiment of the invention, the curved surface member is formed by two portions of different curvatures, a front portion having a smaller radius of curvature than a rear portion, the two portions being connected to each other in a continuous manner in correspondence with an area situated below the mid-front part of the footrest surface.

In another particularly preferred embodiment of the invention, the equipment is formed by three components which can be connected to one another in a removable manner. In particular, said components are a flat member constituting the footrest surface and two cylindrical sectors whose side surfaces correspond substantially to the front and rear portions, each with a different curvature, of said curved surface member. Thus, by removing one or both curved surface portions, the equipment can be used not only for dynamic flexion exercises, but also for exercises of static flexion or gait on flat surfaces.

DESCRIPTION OF THE DRAWINGS

Further characteristics and advantages of the equipment according to the present invention will become more apparent in the following description of a few of its embodiments, given as examples and not limitative, with reference to the attached drawings in which.

DESCRIPTION OF THE PREFERRED EMBODIMENT

Figure 1:
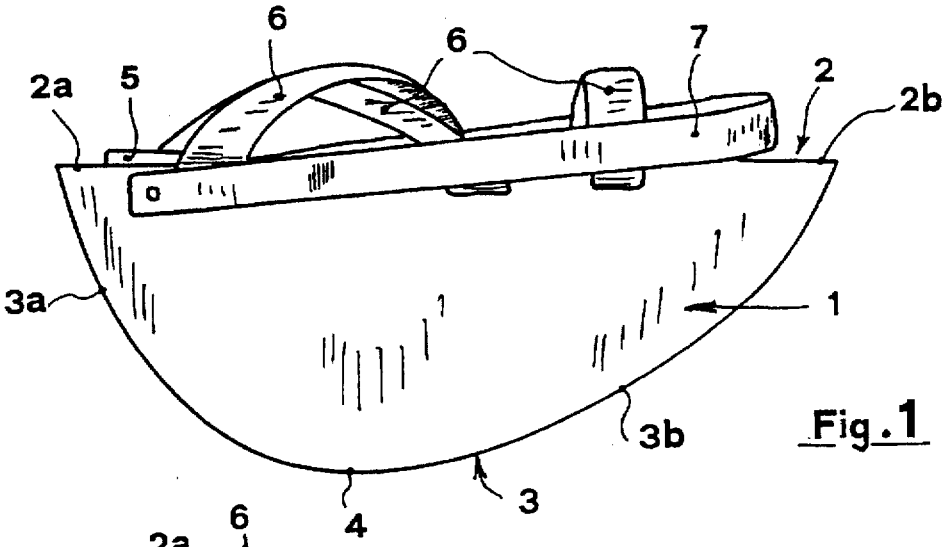
FIG. 1 is a side view of a first embodiment of the equipment according to the present invention.
Figure 2:
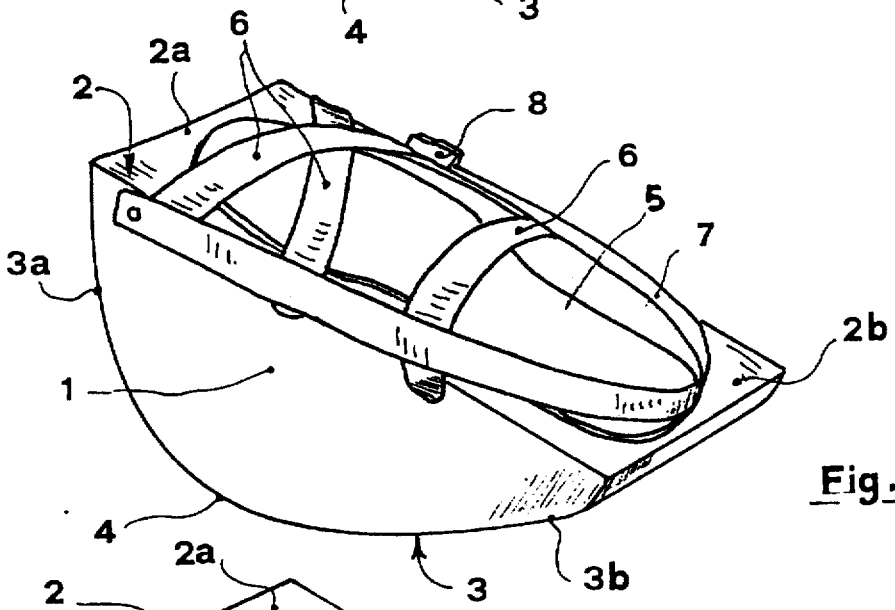
FIG. 2 shows the equipment of FIG. 1 in a top perspective view.

With reference to FIGS. 1 and 2, 1 indicates a substantially semicylindrical body with a footrest surface 2 for supporting the foot and a curved surface 3 formed by two portions 3*a* and 3*b* of different curvatures which connect in a continuous manner in an area 4 of said curved surface which is located nearer to one of the two ends of body 1. On footrest surface 2, a front part or end 2*a* and a rear part or end 2*b* are defined in relation to the position the foot will assume on the surface itself.

The side profile of body 1 appears, therefore, asymmetrical, both because of the different curvatures of the curved surface as well as the position of the area of connection between the two surfaces of different curvatures. More precisely, the more curved surface portion 3*a* extends from front end 2*a* of footrest 2 and the area of connection between the two portions of surface is located toward front end 2*a* and is practically in correspondence with the mid-front area of footrest surface 2. The curve is preferably smooth and convex, as seen in FIG. 1.

On footrest surface 2, a sole 5 is advantageously provided in soft material and, possibly, in an anatomical form for a more comfortable resting of the foot on surface 2. It is also possible to anatomically shape footrest surface 2 for the direct resting of the bottom of the foot upon it. As a further alternative, a shoe can be provided on surface 2 in a fixed or removable way. A few bands or straps 6 are fixed to the edges of body 1 and extend transversally over surface 2 to hold the foot in position. An adjustable strap 7, also fixed the edges of body 1, extends in a longitudinal direction in order to hug the foot at the ankle. Strap 7 also comprises a buckle 8 which makes it possible to vary the length so that it can be adapted to the dimensions of the foot rested on surface 2. In fact, the equipment according to the invention will be advantageously realized in such a way that it can be utilized by patients with different foot sizes included in a predetermined size range.

The correct positioning of the foot on surface 2 will, therefore, be carried out by adjusting the length of strap 7.

Figure 3:
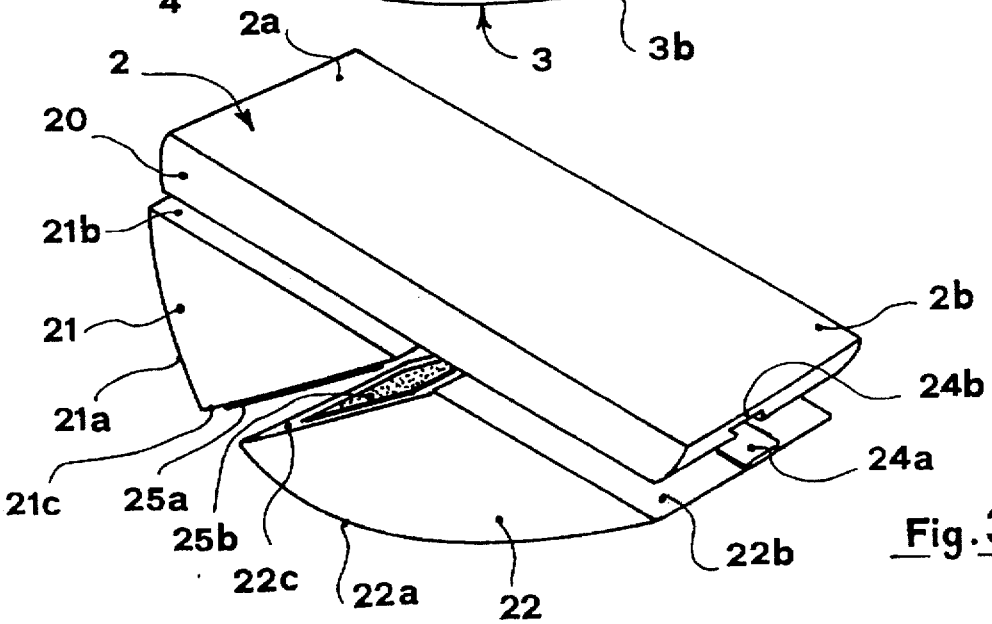
FIG. 3 schematically shows an exploded perspective view of a second embodiment of the equipment according to the present invention.

Advantageously, on surface 2 or on sole 5, reference signs can be provided to indicate the correct position of the heel or toe of the foot corresponding to each size. With reference to FIG. 3, body 1 forming the equipment according to the present invention can advantageously be realized in three connectable parts consisting in a substantially flat member 20 comprising footrest surface 2 and two cylindrical sectors 21 and 22 which can be connected in such a way as to define curved surface 3, each of them having, in fact, a respective curved side 21*a* and 22*a* corresponding to the two portions of curved surface 3*a* and 3*b* of different curvatures. The two sectors 21 and 22 have, furthermore, two flat faces which, once the sectors are connected, are coplanar, and on which flat member 20 rests. To connect flat member 20 to the two sectors 21 and 22, various means of connection of a known type can be used. For example, as illustrated in FIG. 3, a dovetail joint can be used in which male element 24*a* is formed longitudinally on coplanar surfaces 21*b*, 22*b*, whereas female element 24*b* is formed on member 20, in correspondence to male element 24*a*. To joint sectors 21 and 22 with one another after having connected them to element 20 by means of the dovetail joint 24*a,b*, on their opposite facing sides 21*c* and 22*c*, male and female elements 25*a,b* of, for example, a Velcro-type joint can be provided or an equivalent reversible connection device.

The above embodiment of the equipment according to the invention makes it possible to carry out the exercises of dynamic flexion, static flexion and gait on flat surfaces as will be described more clearly further on.

Figure 4:
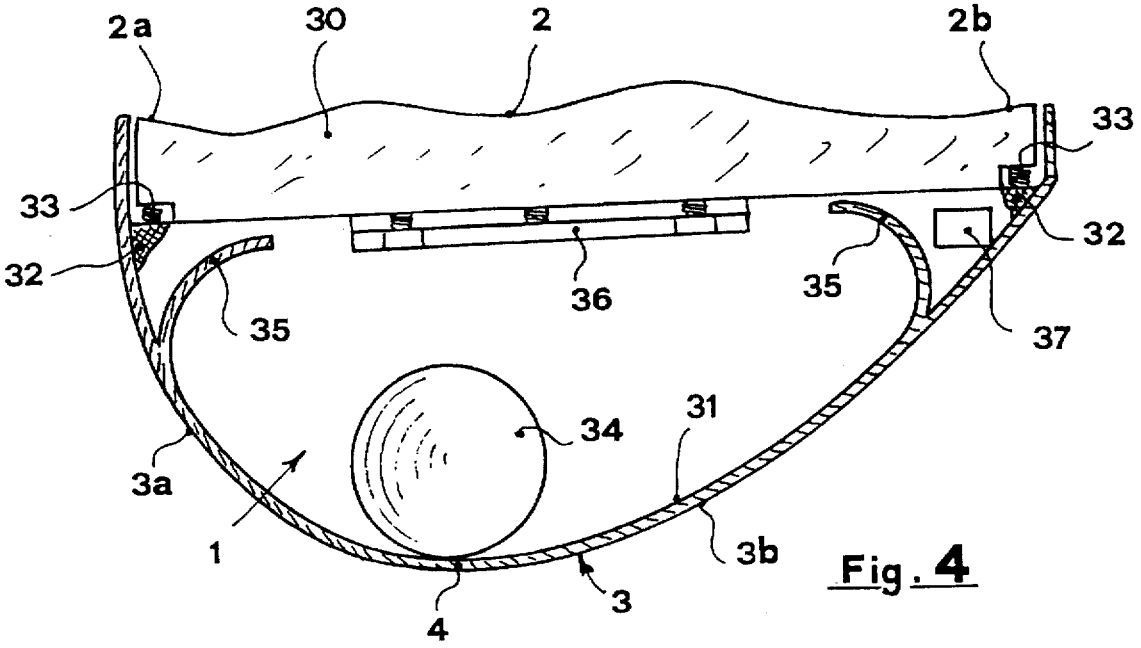
FIG. 4 is a side sectional view of a third embodiment of the equipment according to the invention.
Figure 5:
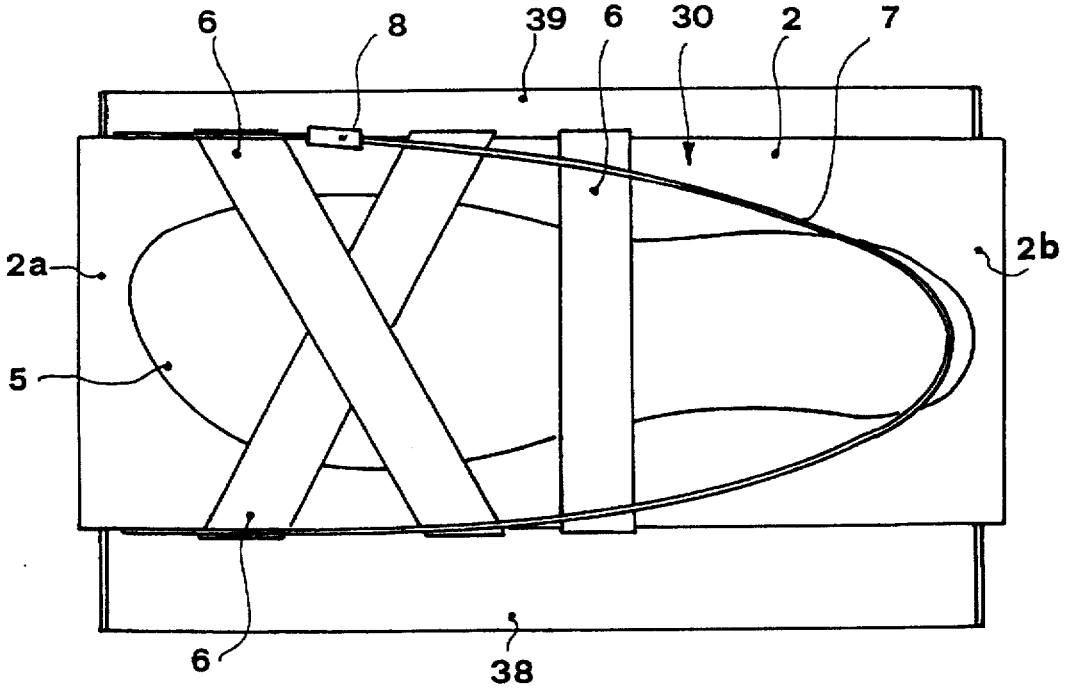
FIG. 5 is a top plan view of the equipment of FIG. 4.

In FIGS. 4 and 5, a further embodiment of the equipment according to the present invention is shown in which body 1 of the equipment is hollow and in particular is formed by a substantially flat element 30 on one face of which footrest surface 2 is formed, possibly shaped anatomically, as well as by a curved plate element 31 substantially in the form of half of a cylindrical surface closed by said flat element 30. The cylindrical surface of element 31 is curved with the same profile as that of the embodiments described above. It has, in other words, two surface portions 3*a* and 3*b* of different curvatures connected to one another in an area 4 located nearer to anterior end 2*a* of surface 2. Element 30 rests on brackets 32 extending from the inner wall of element 31 and is connected to them by elastic means, schematically shown and indicated by 33, of any known type. Inside element 31, a spheric body 34, for example made of metal, is housed having a weight of 0.5, 1.0 or 2.0 Kg according to the intended use, which is able to roll on the bottom wall of body 31 between two side walls 35 situated immediately underneath flat element 30 in correspondence with front end 2*a* and rear end 2*b* of surface 2. Following the swinging movement of the equipment during the exercises, spheric body 34 increases the dynamism, owing to its inertia, of the movement itself, thus enhancing the strength and elasticity of the ankle and leg.

The hollow configuration of body 1 makes it possible to supply the equipment according to the present invention with numerous accessories. For example, it can be provided with an electric battery-operated vibrator 36 applied under flat element 30, suited to stimulate the bottom of the foot which, as known from reflexology studies, can be beneficial and therapeutically advisable. Furthermore, an electronic sound reproducing device 37 of any known type may be housed inside body 1 and may be connected to a small control panel (not shown) placed on one of the side walls of body 1 and suited for performing various functions such as giving the rhythm of the various exercises, providing technical instructions for the correct execution of the exercises and so on. Furthermore, from the two opposite sides of curved surface 3 of element 31, or also in the previously described embodiments, in a position surrounding and more or less close to connection area 4, two tongues 38 and 39 extend coplanarly to the curved surface with the function of increasing the lateral stability to the equipment. In this case, in the piece of equipment destined for the left foot, the external tongue, in other words tongue 38 of the embodiment illustrated in FIG. 5, has a greater width than internal tongue 39 in order to prevent interference between the internal tongues of the right and left pieces of equipment, if they are used simultaneously.

The equipment according to the present invention is used by applying it to the foot or feet to be treated after having adjusted the length of strap 7 as a function of foot size. The exercise to be carried out consists in a back-and-forth rocking movement which is achieved substantially by shifting the body's barycenter back and forth. The back-and-forth rocking gradually accentuates, accordinq to need, the dorsal and planter flexion alternatively. Because of its features, the equipment according to the present invention makes it possible to act on both the articular, tendinous and capsular component, as well as on the muscular component, causing a series of modifications aimed at the strengthening and improvement of movement. Such induced modifications include the lengthening of the muscle-tendon apparatus, the increase of elasticity and muscular strength, a more effective coordination between agonistic and antagonistic muscles, a greater postural stability and a better control of equilibrium. In addition to the strengthening of all of the muscular groups of the lower limbs (foot, leg, thigh, cingulum extremitatis inferioris), a complete mobilization of the spine and, therefore, of the whole body is produced. The increase of muscular perception stimulated by the use of the equipment according to the invention constitutes the neurological and physiological basis for the acquisition of correct corporeal schemes in static conditions as well as in dynamic conditions. The increase of corporeal perception increases, as known, the feeling of physical well-being and therefore contributes to reducing stress.

The exercise carried out with the equipment according to the invention, which is executed maintaining an erect position, starting from the foot sequentially involves the body segments above it connected to each other like links in a chain. Therefore, the oscillation of the foot causes a movement of alternating flexion and extension of the leg and thus of the thigh and the cingulum extremitatis inferioris, performing the dual function of stretching and strengthening the individual muscles and coordinating functionally connected and complementary muscular groups. The involvement of the cinqulum extremitatis inferioris, a particularly important structure in maintaining an erect position, causes the activation of the spine and any potential movement thereof.

The equipment accomplishes the aims of stretching, strengthening and coordinating muscles of various body segments (lower limbs and in particular the knee joint, cingulum extremitatis inferioris, spine and, therefore, trunk and head) by means of exercises simulating walking in place and running as well as by means of gait, possibly carried stretched between hands and feet.

Particularly in the sectional embodiment of FIG. 3, the equipment can be used as a static base for resting the foot in exercises of stretching of the posterior musculature of the legs and the musculature of the trunk which are frequently contracted by unhealthy habits of lifestyle. This multiplicity of applications makes the equipment according to the present invention suitable not only to use for purposes of rehabilitation, prevention and athletic training, but also in the home or in the work place to complete daily activities.

Further variations and/or modifications can be made to the equipment for carrying out exercises of anterior and posterior flexion of the foot according to the present invention without departing from the scope of the invention itself as stated in the appended claims.

I claim:

1. Equipment for a user having a body and a foot to carry out anterior and posterior flexion exercises on a plane of execution by forward and backward movements of the user's body, the equipment comprising a device including:

a footrest surface portion for supporting the user's foot;

a centering and fixing structure for holding the foot onto the footrest surface portion; and a curved surface portion comprising rolling means to roll on the place of execution, wherein said curved surface portion is substantially semi-cylindrical and includes a front portion and a rear portion having respectively different radii of curvature connecting with one another in a continuous manner in an area situated in correspondence with a mid-front part of said footrest surface portion.

2. The equipment according to claim 1, wherein the front portion of said curved surface portion has a radius of curvature smaller than that of the rear portion.

3. The equipment according to claim 1, comprising a vibrator device applied on an inside face of said footrest surface portion.

4. The equipment according to claim 1, wherein the device includes an electronic sound reproducing device housed therein and outside means for operating the sound reproducing device.

5. The equipment according to claim 1, wherein two coplanar tongues for preventing lateral tilting extend at a side of said curved surface portion along an intermediate length thereof.

6. The equipment according to claim 1, wherein said centering and fixing means comprise transverse straps for holding the foot and a longitudinal strap of adjustable length suited to hug the foot around an ankle thereof.

7. The equipment according to claim 1, comprising a sole applied on said footrest surface.

8. The equipment according to claim 1, comprising a shoe applied on said footrest surface.

9. The equipment according to claim 1, wherein said footrest surface is anatomically shaped.

10. The equipment according to claim 1, wherein the curved surface portion comprises cylindrical portions.

11. The equipment according to claim 1, wherein the curved surface portion is everywhere convex in a front-to rear direction.

12. Equipment for a user having a body and a foot to carry out anterior and posterior flexion exercises on a plane of execution by forward and backward movements of the user's body, the equipment comprising a device including:

a footrest surface portion for supporting the user's foot;

centering and fixing means for holding the foot onto the footrest surface portion; and a curved surface portion comprising rolling means to roll on the place of execution, wherein said footrest surface portion is formed on one face of a substantially flat element which is connected in a removable manner by another face thereof to coplanar surfaces of two front and rear substantially cylindrical sectors comprising said curved surface portion, the sectors having curved surfaces having different radii of curvature.

13. The equipment according to claim 12, wherein reversible means of connection are provided between said substantially cylindrical sectors.

14. Equipment comprising means for a user having a body and a foot to carry out anterior and posterior flexion exercises on a plane of execution by means of forward and backward movements of the user's body; the equipment comprising a device including:

a footrest surface portion comprising means for supporting the user's foot;

centering and fixing means for holding the foot onto the footrest surface portion; and a curved surface portion comprising rolling means to roll on the plane of execution;

and wherein said curved surface portion is hollow and a revolving body is housed therein, said revolving body having a weight sufficient to exert a perceptible force of inertia on said equipment during its movement.

* * * * *